US005821691A

United States Patent [19]

Richie et al.

[11] Patent Number: 5,821,691

[45] Date of Patent: Oct. 13, 1998

[54] EL PANEL WITH CONTINUOUS CONTACTS ON BACK OF PANEL

[75] Inventors: Benjamin L. Richie, Scottsdale; Kristin R. Lavanway, Mesa; Ramona R. Fechter, Chandler; Rodney T. Eckersley, Tempe; Thomas C. Ensign, Jr., Scottsdale, all of Ariz.

[73] Assignee: Durel Corporation, Chandler, Ariz.

[21] Appl. No.: 818,011

[22] Filed: Mar. 14, 1997

[51] Int. Cl.[6] ..... H01J 1/62

[52] U.S. Cl. ..... 313/506; 313/509; 313/510; 313/512

[58] Field of Search ..... 313/505, 506, 313/509, 510, 512

[56] References Cited

U.S. PATENT DOCUMENTS

| | | | |
|---|---|---|---|
| 2,928,974 | 3/1960 | Mash | 313/108 |
| 3,109,959 | 11/1963 | DeLachapelle et al. | 315/74 |
| 3,573,532 | 4/1971 | Boucher | 313/509 |
| 5,302,468 | 4/1994 | Namiki et al. | 313/506 |
| 5,491,379 | 2/1996 | Daigle et al. | 313/509 |
| 5,621,274 | 4/1997 | McGuigan | 313/512 |

*Primary Examiner*—Vip Patel
*Attorney, Agent, or Firm*—Paul F. Wille

[57] ABSTRACT

At least one conductive layer runs the length of an EL panel and individual lamps are connected to the conductive layer. In one embodiment of the invention, the electroluminescent layer of the panel does not cover a portion of the front electrode and the conductive layer is electrically coupled to the exposed portion of the front electrode. In another embodiment of the invention, the EL panel includes at least two rear electrodes and the conductive layer is coupled to one of the rear electrodes. An insulating layer between the conductive layer and other parts of the EL panel prevents unintended electrical connections to the conductive layer.

10 Claims, 2 Drawing Sheets

EL PANEL WITH CONTINUOUS CONTACTS ON BACK OF PANEL

BACKGROUND OF THE INVENTION

This invention relates to an electroluminescent (EL) panel and, in particular, to an EL panel in which the electrical contacts to the front electrode and the rear electrode can be made at any place along the length of the panel and are accessible from the rear of the panel. As used herein, an EL "panel" is a single substrate including one or more luminous areas, wherein each luminous area is an EL "lamp."

An electroluminescent (EL) lamp is essentially a capacitor having a dielectric layer between two conductive electrodes, one of which is transparent. The dielectric layer can include a phosphor powder or there can be a separate layer of phosphor powder adjacent the dielectric layer. The phosphor powder radiates light in the presence of a strong electric field, using very little current.

A modern (post-1980) EL panel includes a front electrode that is typically a thin, transparent layer of indium tin oxide or indium oxide on a substrate such as a sheet of polyester or polycarbonate, which provides mechanical support for the other layers. Such coated sheets are commercially available. The panel is typically made by screen printing a phosphor layer on the front electrode, then screen printing a dielectric layer on the phosphor layer, and then screen printing a rear electrode on the dielectric layer. Individual lamps are made by cutting or punching the sheet.

An EL lamp is luminous only where the front electrode and the rear electrode overlap and only if there is an AC voltage across the electrodes. It is relatively easy to make electrical contact to the rear electrode. The front electrode is buried between the transparent substrate and the phosphor layer. Typically, the screen printed layers are patterned or are printed over a slightly smaller area than the front electrode to expose a portion of the front electrode U.S. Pat. No. 5,491,379 (Daigle et al.) describes an EL lamp in which the front electrode is exposed along one edge of a panel and a conductive contact is printed on the exposed front electrode and over a portion of the rear electrode, separated from the rear electrode by an insulating layer. This provides electrical contact to both electrodes within a small area on the rear of the lamp. A plurality of such contacts are printed along the length of the panel, corresponding to the locations of the lamps. U.S. Pat. No. 3,109,959 (DeLaChapelle et al.) discloses essentially the same idea implemented in pre-1980's technology; i.e. the lamp layers are not screen printed and a metal clip (rather than a screen printed conductor) extends around the layers to make contact with the front electrode. The clip is separated from the rear electrode by an insulating layer.

There are problems with known lamp constructions. A panel is not easily adapted to making lamps of different designs or sizes. Screen printing the contact areas is not compatible with continuous production techniques, known as roll-to-roll construction. While many customers simply want a uniformly back-lit graphic, typically defined in an overlay or overprint, there is a need for providing an EL panel containing a plurality of graphics defined in the lamp itself, i.e. by patterning one or more of the layers in a panel. Patterning the front electrode or the rear electrode restricts light emission to the areas of overlap. Patterning the phosphor layer enables one to provide an image containing more than one color.

Roll-to-roll construction enables one to make EL panels having a large area at low cost and essentially continuously.

For example, one can roll coat suitable inks for the phosphor layer, the dielectric layer, and the rear electrode consecutively. Alternatively, one can laminate suitable films to a transparent, coated substrate. Both of these techniques use starting materials stored on rolls and can take up product on rolls, although one may prefer to take the product from a roll-coating station or a lamination station and cut the product into panels for further treatment. The resulting panels need not be plain. One can combine roll-to-roll construction with patterning to produce a wide variety of lamps. Roll-to-roll construction is used for as much of the process as possible and, thereafter, less efficient techniques are used, e.g. screen printing, to make panels that display a graphic.

Whether EL panels are made by a continuous process, by a batch process, or by a combination of processes, access to the front electrode is a problem because the front electrode is on the inner side of the transparent substrate.

It is known in the art to omit any contact to the front electrode and to couple voltage capacitively to the front electrode from contacts on the back of a lamp. U.S. Pat. No. 2,928,974 (Mash) discloses an EL lamp having a split rear electrode to which the leads of the lamp are attached. The applied voltage is capacitively coupled to the front electrode and the lamp is equivalent to two capacitors in series with the front electrode common to both capacitors.

In view of the foregoing, it is therefore an object of the invention to provide an EL panel with a bus that extends along a long edge of the panel.

Another object of the invention is to provide an EL panel in which the contact for the front electrode extends continuously along a long edge on the back of the panel.

A further object of the invention is to provide an EL panel that is compatible with continuous processes.

Another object of the invention is to provide an EL panel in which the contact for the front electrode is process independent.

A further object of the invention is to provide a contact for the front electrode that does not restrict or define the location of lamps in an EL panel.

SUMMARY OF THE INVENTION

The foregoing objects are achieved in this invention in which at least one conductive layer runs the length of an EL panel and individual lamps are connected to the conductive layer. In one embodiment of the invention, the electroluminescent layer of the panel does not cover a portion of the front electrode and the conductive layer is electrically coupled to the exposed portion of the front electrode. In another embodiment of the invention, the EL panel includes at least two rear electrodes and the conductive layer is coupled to one of the rear electrodes. An insulating layer between the conductive layer and other parts of the EL panel prevents unintended electrical connections to the conductive layer.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
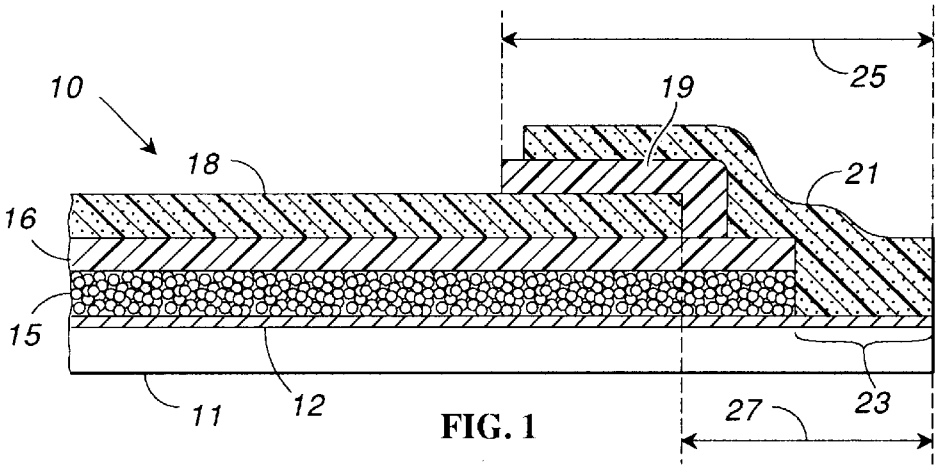
FIG. 1 is a cross-section of an EL panel constructed in accordance with the invention.

FIG. 1 is a cross-section of an EL panel constructed in accordance with the invention. The layers are not shown in proportion. In panel 10, transparent substrate 11 is a sheet of polyester or polycarbonate. Transparent, front electrode 12 overlies substrate 11 and is a thin layer of indium tin oxide or indium oxide. Phosphor layer 15 overlies the front electrode and dielectric layer 16 overlies the phosphor layer. Layers 15 and 16 are combined in some applications. Overlying dielectric layer 16 is rear electrode 18 containing conductive particles such as silver or carbon in a resin binder.

Phosphor layer 15 and dielectric layer 16 are applied to less than all of front electrode 12, leaving region 23 along the right-hand edge of panel 10 as illustrated in FIG. 1. Insulating layer 19 touches dielectric layer 16 and overlies a portion of rear electrode 18. Conductive layer 21 covers most of insulating layer 19 and extends over region 23 of front electrode 12. Region 23 provides a large contact area and layer 21 brings the electrical contact to the rear of panel 10. Preferably, layers 16 and 19 are made from the same material and layers 18 and 21 are made from the same material.

In accordance with the invention, the cross-section illustrated in FIG. 1 is a cross-section taken anywhere along the length of a panel. Front electrode 12 can be patterned or rear electrode 18 can be patterned to produce a graphic but the connections to the front and rear electrode are unchanged along the length of panel 10. Conductive layer 21 is a continuous bus extending along a long edge on the back of panel 10. Thus, lamps can be located anywhere along the length of panel 10.

Figure 2:
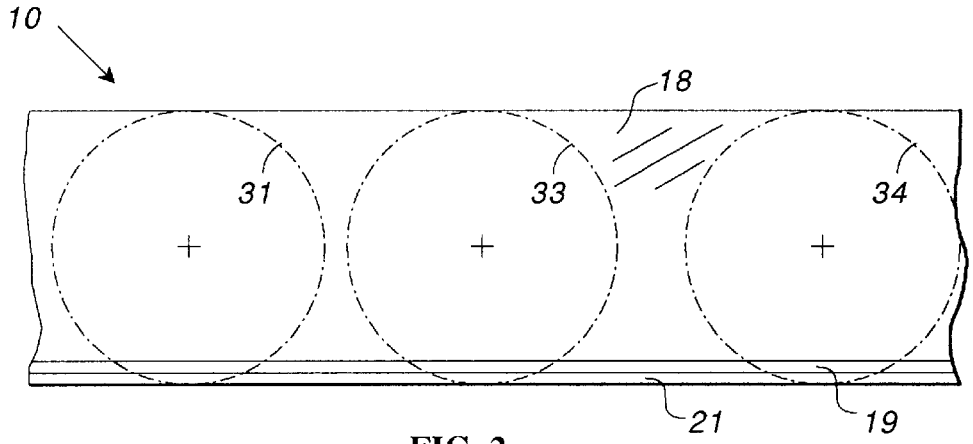
FIG. 2 is a plan view of an EL panel constructed in accordance with the invention.

FIG. 2 is a plan view of an EL panel constructed in accordance with the invention and is not drawn to scale. In FIG. 2, cut lines 31, 33, and 34 are circular in shape, as would be the case for lamps back-lighting the dial of a watch. FIG. 2 illustrates panel 10 as seen from the back with conductive layer 21 extending along the lower edge of lamp 10. Conductive layer 21 is separated from rear electrode 18 by insulating layer 19, which extends out from under conductive layer 21. The spacing between these lines in FIG. 2 is exaggerated for illustration.

As illustrated in FIG. 1, the bus has width 25, measured across the narrow dimension of the panel. In practice, the bus can be as wide as desired, provided there is room to contact the rear electrode, or as narrow as desired, provided there is enough room for reliable contact. In one embodiment of the invention, width 25 was 469 mils (11.92 mm). Of that width, insulating layer 19 extended 16 mils (0.92 mm) from the edge of conductive layer 21. An important parameter, for customers, is dark space. Any area not covered by the rear electrode is dark. In one embodiment of the invention, region 23 had a width of 10 mils (0.25 mm) as blanked, that is, in an individual lamp.

In FIG. 2, cut lines 31, 33, and 34 are not on uniformly spaced centers. More specifically, contact to the front electrode (not shown in FIG. 2) can be made anywhere along conductive layer 21. The contact for each lamp is not defined by the construction of the panel. Rather, the contact area for each lamp is defined by cutting or punching a lamp from panel 10. Because individual contacts are not defined, cumulative error is reduced (an error in locating the punch is not compounded by an error in locating a contact).

Figure 3:
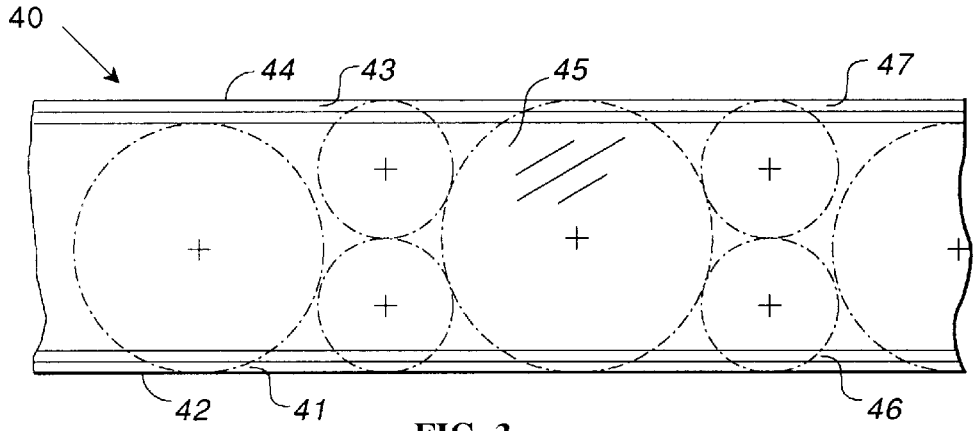
FIG. 3 is a plan view of an EL panel constructed in accordance with an alternative embodiment of the invention.

FIG. 3 illustrates an EL panel constructed in accordance with an alternative embodiment of the invention. Specifically, panel 40 differs from panel 10 by including conductive layer 41 along lower edge 42 and further including conductive layer 43 along upper edge 44. Conductive layer 41 is separated from rear electrode 45 by insulating layer 46. Conductive layer 43 is separated from rear electrode 45 by insulating layer 47.

The construction illustrated in FIG. 3 enables one to provide contacts on opposite sides of a lamp or to cut a plurality of different sizes and shapes of lamps from panel 40. As illustrated by a plurality of circular cut lines, lamps of different diameter can be nested in panel 40 to minimize waste in cutting lamps from the panel. The lamps need not be on uniformly spaced centers and the centers need not be uniformly located between the long edges of panel 40. Panel 40 is compatible with continuous production processes because conductive layers 41 and 43 and insulating layers 42 and 44 extend longitudinally along the edges of panel 40. Lamps constructed from panel 10 (FIG. 2) or from panel 40 have minimum dark space because the rear electrode extends under the bus, i.e. the dark space at the edge of the panel is approximately one-half the width of the bus.

Figure 4:
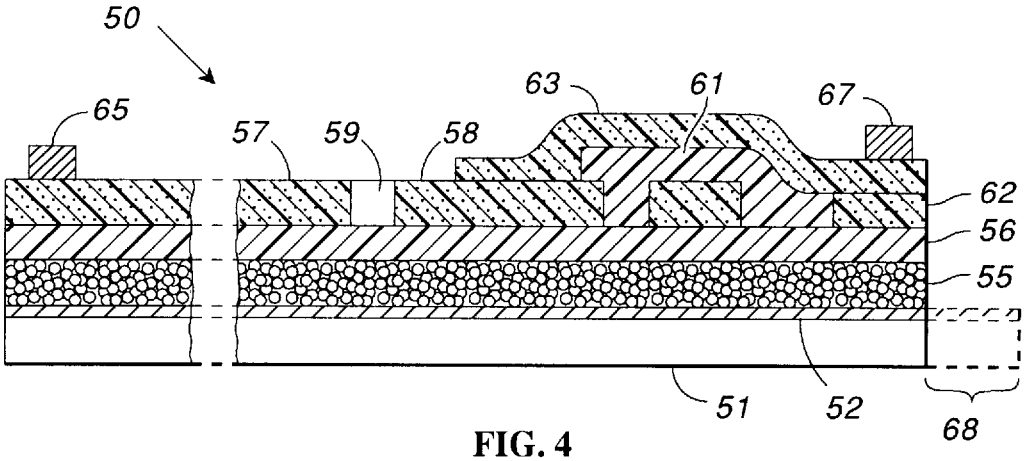
FIG. 4 is a cross-section of an EL panel constructed in accordance with another aspect of the invention.

FIG. 4 is a cross-section of an EL panel constructed in accordance with another aspect of the invention. Transparent substrate 51 is a sheet of polyester or polycarbonate having transparent front electrode 52 deposited thereon. Phosphor layer 55 overlies front electrode 52 and dielectric layer 56 overlies phosphor layer 55. The front electrode is completely covered and the rear electrode is split into two or more electrodes. That is, the conductive layer overlying dielectric layer 56 is patterned to produce a plurality of rear electrodes. An AC voltage applied to one rear electrode is capacitively coupled by the front electrode to another rear electrode.

Rear electrode 57 and rear electrode 58 are separated by gap 59 for defining a suitable graphic. Insulating layer 61 overlies a portion of dielectric layer 56, a portion of rear electrode 57, and fills a portion of gap 59, forming an insulating bridge between rear electrode 58 and conductive layer 62. Conductive layer 62 overlies dielectric layer 56 and extends along the length of panel 50, into the plane of FIG. 4.

Bus bar 65 and bus bar 67, which preferably are made from a silver bearing ink or a copper laminate, overlie rear electrode 57 and conductive layer 62 at opposite edges of panel 50. The lamps in panel 50 are lit by applying an AC voltage across bus bars 65 and 67. If a plurality of lamps are defined by the patterned rear electrode, then all of the lamps are lit simultaneously if they are coupled to the buses by suitable bridges.

Area 68, which is an extension of front electrode 52, indicates an optional construction in which there is both a patterned rear electrode and a rear connection to the front electrode, as illustrated in FIG. 1. For connection to front electrode 52, bus bar 67 is coupled to the front electrode by a conductive layer (not shown) and all of the areas of the patterned rear electrode are connected to bus bar 65, either directly or by conductive bridges.

Figure 5:
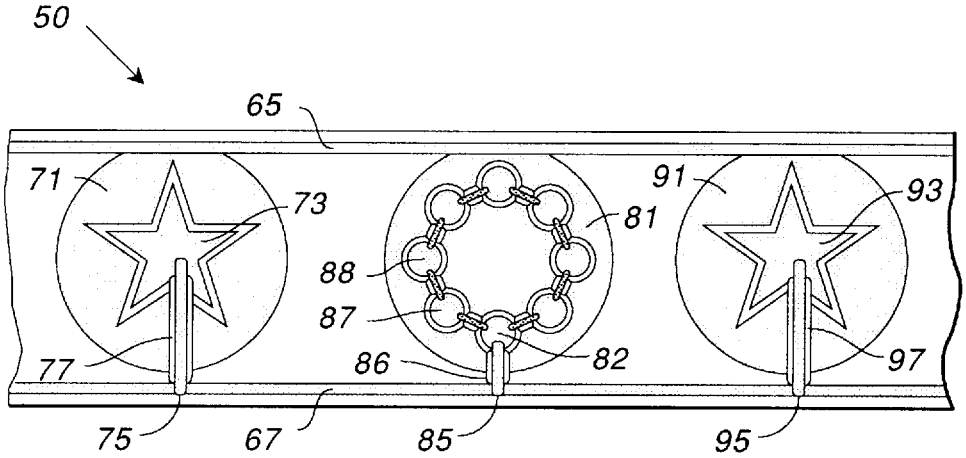
FIG. 5 is a plan view of an EL panel constructed in accordance with another aspect of the invention.

FIG. 5 is a plan view of panel 50 as seen from the back. Panel 50 includes examples of two designs that can be made by patterning the rear electrode to make several smaller rear electrodes. As with panels 10 and 40, the various graphic displays need not be on uniformly spaced centers.

Rear electrode 71 is directly connected to bus bar 65, which runs the length of panel 50. Rear electrode 73 is electrically connected to bus bar 67 by bridge 75. Conductive bridge 75 overlies insulator 77, separating bridge 75 from rear electrode 71. Rear electrode 81 is directly connected to bus bar 65. Rear electrode 82 is electrically connected to bus bar 67 by bridge 85. Conductive bridge 85 overlies insulator 87, separating bridge 85 from rear electrode 81. Other rear electrodes, such as rear electrode 87 and rear electrode 88, are connected to rear electrode 82, and bus bar 67, by a series of bridges, as shown. Rear electrode 71 is directly connected to bus bar 65. Rear electrode 93 is electrically connected to bus bar 67 by bridge 95, which overlies insulator 97 separating bridge 95 from rear electrode 91.

In many applications, a lamp panel is not cut or divided into individual lamps but is kept intact with a plurality of lamps, e.g. in an instrument panel. Bus bar 65 and bus bar 67 provide a low resistance connection to all lamps in a panel, thereby facilitating testing or facilitating the operation of the panel if left intact.

The invention thus provides an EL panel in which the contact for the front electrode extends continuously along a long edge on the back of the panel whereby the contact does not restrict or define the location of lamps in the EL panel. A patterned rear electrode is easily accommodated by the continuous contact and a plurality of lamps of various sizes can be included in a single panel. Connections to the panel are made to the back of the panel and contact areas of uniform geometry can be provided for dissimilar lamps.

Having thus described the invention, it will be apparent to those of skill in the art that various modifications can be made within the scope of the invention. For example, the width of area 23 (FIG. 1) or 68 (FIG. 4) is not critical because some of the area is trimmed when lamps are blanked from the panel. The amount of overlap between conductive layer 21 and rear electrode 18 is a matter of choice determined by a particular application.

What is claimed as the invention is:

1. An EL panel having a length and a width, said EL panel comprising:

a transparent substrate;

a front electrode overlying said substrate and having at least a first edge parallel with and extending along said length;

an electroluminescent layer overlying said front electrode except along said first edge, leaving an exposed portion of the front electrode extending substantially the length of said panel;

a first conductive layer overlying said electroluminescent layer;

a first insulating layer extending along said edge and overlying a first portion of said first conductive layer adjacent said edge;

a second conductive layer overlying said insulating layer for providing electrical contact anywhere along said edge.

2. The EL panel as set forth in claim 1 wherein:

said first conductive layer is patterned to provide a plurality of rear electrodes;

said insulating layer overlies a portion of a first of said plurality of rear electrodes; and said second conductive layer overlies a second of said plurality of said rear electrodes.

3. The EL panel as set forth in claim 2 and further including a first bus bar overlying said first conductive layer and extending along said length.

4. The EL panel as set forth in claim 3 and further including a second bus bar overlying said second conductive layer and extending along said length.

5. The EL panel as set forth in claim 1 wherein said second conductive layer also overlies said exposed portion of said front electrode and extends substantially the length of said panel, thereby providing contact to said front electrode anywhere along said edge.

6. The EL panel as set forth in claim 5 wherein said insulating layer extends substantially the length of said panel.

7. The EL panel as set forth in claim 5 wherein said insulating layer extends away from said edge a predetermined amount to separate said second conductive layer from said first conductive layer.

8. The EL panel as set forth in claim 6 wherein said insulating layer extends away from said edge a predetermined amount to separate said second conductive layer from said first conductive layer.

9. The EL panel as set forth in claim 5 wherein said electroluminescent layer overlies said front electrode except along a second edge parallel with said length, leaving a second exposed portion of the front electrode extending substantially the length of said panel.

10. The EL panel as set forth in claim 9 and further comprising:

a second insulating layer extending along said second edge and overlying a second portion of said first conductive layer adjacent said edge;

a third conductive layer overlying said second insulating layer for providing electrical contact anywhere along said edge.

* * * * *